United States Patent [19]

Takeda et al.

[11] Patent Number: 4,624,409

[45] Date of Patent: Nov. 25, 1986

[54] APPARATUS FOR FINELY DIVIDING MOLTEN METAL

[75] Inventors: Tohru Takeda, Yamato; Kazumi Minagawa, Matsudo, both of Japan

[73] Assignee: National Research Institute for Metals, Tokyo, Japan

[21] Appl. No.: 691,312

[22] Filed: Jan. 14, 1985

[30] Foreign Application Priority Data

Jan. 19, 1984 [JP] Japan ..... 59-6352

[51] Int. Cl.[4] ..... B22F 9/08

[52] U.S. Cl. ..... 239/11; 75/0.5 C; 239/290; 239/419.5; 239/424

[58] Field of Search ..... 75/0.5 R, 0.5 C; 239/1, 239/8, 11, 79, 290, 299, 419.5, 424, 427.5, 591

[56] References Cited

U.S. PATENT DOCUMENTS

| | | | |
|---|---|---|---|
| 2,373,595 | 4/1945 | Peeps | 239/290 |
| 3,093,315 | 6/1963 | Tachiki et al. | 75/0.5 C |
| 3,931,933 | 1/1976 | Cairns et al. | 239/591 |
| 4,194,900 | 3/1980 | Ide et al. | 75/0.5 C |
| 4,274,864 | 6/1981 | Bernhardt et al. | 75/0.5 C X |

FOREIGN PATENT DOCUMENTS

| | | | |
|---|---|---|---|
| 1431522 | 1/1966 | France | 75/0.5 C |
| 6389 | 3/1968 | Japan | 75/0.5 C |

*Primary Examiner*—Andres Kashnikow

*Attorney, Agent, or Firm*—Wenderoth, Lind & Ponack

[57] ABSTRACT

A method and an apparatus for finely dividing a molten metal by atomization is provided herein. This apparatus includes a nozzle for feeding a molten metal and an annular atomizing nozzle to force a high-pressure liquid jet against a stream of the molten metal flowing from the feed nozzle. The atomizing nozzle is made of an annular jetting zone adapted to form a narrow opening under the pressure of the high-pressure liquid, an inside jacket and an outside jacket adjacent to the annular jetting zone. The apparatus further includes a pressure reduction chamber located beneath the atomizing nozzle which is in contact with the lower part of the jet from the atomizing nozzle.

7 Claims, 3 Drawing Figures

APPARATUS FOR FINELY DIVIDING MOLTEN METAL

BACKGROUND OF THE INVENTION

1. Field of the Invention

This invention relates to an apparatus and an method for finely dividing a molten metal by atomization.

2. Description of the Prior Art

In the production of grinding diamond wheels, tipped tools of high-speed steel, preforms of machine parts for hot isostatic pressing, preforms for injection molding, etc. by powder metallurgy, metal powders used as starting materials are required to have an average particle diameter of several micrometers.

Previously, the oxide reduction method, the electrolytic method, the carbonyl method, etc. have been known for the production of metal powders. These methods are suitable for the production of powders of a single metal, but for the production of fine powders of alloys, have the defect that restrictions on the compositions of the alloys make it difficult to powderize them, and the cost of production becomes high.

The atomizing method has been widely used for the production of alloy powders. The average particle diameter of the alloy powders produced by this method is several tens of micrometers at the smallest, and it has been considered impossible to produce alloy powders which are 1/10 times smaller.

For the powderization of a molten metal by the atomizing method, a conical jet process is considered most effective which comprises using a liquid, generally water, as a atomizing medium and concentrating the energy of a jet of the atomizing medium on one point. An apparatus of the type shown in FIG. 1 is known to be used in this process (see the specification of Japanese Patent Publication No. 6389/68). With this apparatus, a water jet is propelled from an annular zone defined by an outside nozzle jacket 7 and an inside nozzle jacket 8 to form a conical surface having a convergence point at one point 0 on the axis of the annular zone. The jetting of the liquid is caused by pressure from a liquid introducing pipe 9. In the meantime, a molten metal is let fall as a molten metal stream 13 from a molten metal feed nozzle 12. The air pressure is usually a negative pressure of 10 to 100 torr inwardly of the conical surface formed by the water jet, namely in the vicinity of the jet on the molten metal flowing side, and the molten metal stream 13 is sucked toward that site without swaying. On the other hand, the air pressure exteriorly of the jet is nearly 1 atmosphere. The average particle diameter of the resulting metal powder becomes smaller as the jetting pressure (speed) of the jet and the apex angle $\theta$ of the cone become larger. Industrially, the atomizing is carried out at a maximum jetting pressure of 200 kgf/cm$^2$ and a cone apex angle of $20° < \theta \leqq 40°$. If the apex angle $\theta$ is further increased, the jet stream flows backward from the convergence point 0 to blow the molten metal upwardly, and the atomizing can no longer be continued. The critical apex angle, which is the largest $\theta$ value at which the atomizing can be continued, becomes smaller as the jetting pressure becomes higher.

Japanese Laid-Open Patent Publication No. 114467/1979 discloses a similar apparatus in which the $\theta$ value is increased. In this apparatus, a long suction pipe adhering intimately to the bottom of the nozzle is provided concentrically with the axis of the jet. By propelling the jet into this pipe, the amount of air flow sucked together with the molten metal from the upper portion of the nozzle is increased and the backward flowing of the jet from the convergence point is suppressed. Consequently, the atomizing can be effected while maintaining the apex angle at $80° < \theta < 120°$. With this apparatus, however, the jet gets mixed with the air sucked in a large amount by the action of the suction pipe. As a result, it expands to the diameter of the suction pipe and decreases in density. The jet energy acting on powderization is inevitably decreased. When the jetting of water is carried out in an inert gas, a large amount of the inert gas is consumed, and therefore, the apparatus is not well adapted for water jetting in an inert gas atmosphere.

SUMMARY OF THE INVENTION

It is an object of this invention to provide an apparatus for finely dividing not only a single metal but also an alloy by atomization to give a powder having an average particle diameter of about 4 to 6 micrometers.

Another object of this invention is to provide an apparatus for finely dividing a metal or alloy by atomization in which the apex angle $\theta$ of a conical jet can be maintained at $40° < \theta < 90°$ even when the jetting pressure of a liquid is as high as 400 to 600 kgf/cm$^2$.

Still another object of this invention is to provide an apparatus for finely dividing a metal or alloy by atomization in which the amount of an atmospheric gas to be sucked by a jet stream jetted from an atomizing nozzle can be drastically reduced.

Yet another object of this invention is to provide an apparatus for finely dividing a metal or alloy by atomization in which the efficiency of the powderizing energy of a jet stream can be increased.

A further object of this invention is to provide an apparatus for finely dividing a metal or alloy by atomization which comprises an annular atomizing nozzle having an annular jetting zone with a narrow opening formed uniformly along its entire circumference under the pressure of a liquid.

An additional object of this invention is to provide a method for finely dividing a metal or alloy by atomization, which can lead to the achievement of the aforesaid objects.

According to this invention, there is provided an apparatus for finely dividing a molten metal by atomization, comprising a nozzle for feeding a molten metal and an annular atomizing nozzle for jetting a high-pressure liquid against a stream of the molten metal flowing from the feed nozzle, said atomizing nozzle comprising an annular jetting zone adapted to form a narrow opening therein under the pressure of the high-pressure liquid, an inside jacket and an outside jacket adjacent to said annular jetting zone, and said apparatus further including a pressure reduction chamber located beneath the atomizing nozzle and communicating with the lower part of the jet from the atomizing nozzle.

According to this invention, there is also provided a method for finely dividing a molten metal by atomization which comprises a step of allowing a stream of a molten metal to flow down from a feed nozzle, a step of jetting a high-pressure liquid against the molten metal stream from an annular atomizing nozzle, a step of reducing the pressure of the lower part of the jet from the atomizing nozzle by means of a pressure reduction chamber commmunicating with said lower part, and a step of recovering the finely divided metal, the jetting of the high-pressure liquid being effected at a jetting pressure of 100 to 600 kgf/cm$^2$ so as to form a conical liquid jet having an apex angle $\theta$ of $40° < \theta < 90°$ concentrically with the axis of the atomizing nozzle, and the difference between the negative pressure of the pressure reduction chamber and that of the upper part of the conical jet being maintained at 20 to 690 torr by suction.

BRIEF DESCRIPTION OF THE DRAWINGS

FIG. 2-(B) is a sectional view taken on line A—A' of FIG. 2-(A).

DETAILED DESCRIPTION OF THE INVENTION

Figure 2:
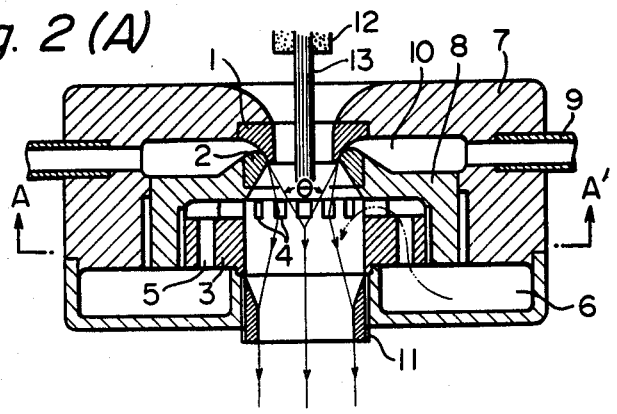
FIG. 2-(A) is a vertical sectional view of the apparatus of this invention for finely dividing a metal by atomization.
Figure 2:
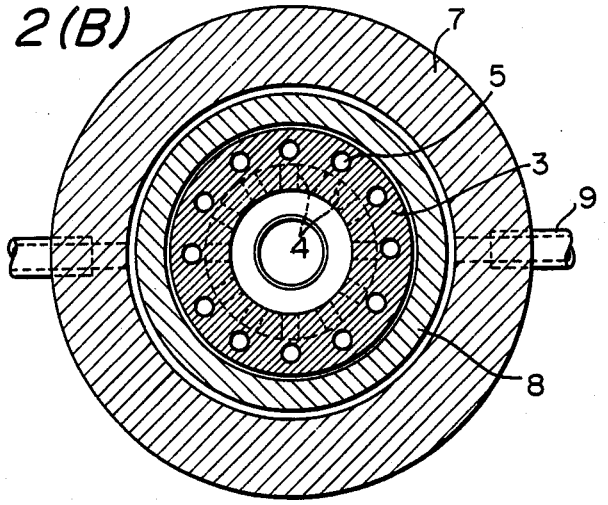

The apparatus and method of this invention will be described in detail with reference to FIGS. 2-(A) and 2-(B) showing one preferred embodiment of this invention.

The apparatus of this invention comprises a nozzle 12 for a molten metal 13 located on its axis at the top portion thereof, and the molten metal 13 is allowed to flow down from the nozzle 12 along the axis of the apparatus. Below the metal feed nozzle 12 is provided an annular atomizing nozzle comprised of an annular jetting zone, an inside jacket 8 and an outside jacket 7. The annular jetting zone is composed of end members 1 and 2 which in the absence of the pressure of a high-pressure liquid on it, are at least partly held in press contact with each other by the compression stress of the outside jacket 7 and the inside jacket 8. Exteriorly of the end members 1 and 2 is provided an annular liquid chamber 10 defined by the end members 1 and 2 and the outside and inside jackets 7 and 8 and communicating with the annular jetting zone. A liquid introducing tube 9 communicating with the liquid chamber 10 is provided exteriorly thereof. When the high-pressure liquid is introduced by a high-pressure pump (not shown) into the liquid chamber 10 through the liquid introducing tube 9, the pressure of the liquid produces a narrow opening between the end members 1 and 2 which have previously been held in press contact, and the liquid is jetted from the narrow opening toward the axis of the annular jetting zone. The degree of press contact between the end members 1 and 2 is controlled by sliding the inside jacket 8 upwardly or downwardly. The direction of the opening between the end members 1 and 2 is determined such that the jetted liquid forms a downwardly directed conical shape concentric with the axis of the spray nozzle. The apex angle $\theta$ of the cone can be preset freely by reserving sets of end members 1 and 2 having different angles of opening between them to the axis of the annular jetting zone for replacement, and selecting a particular set having a desired opening angle in a given operation. The molten metal stream 13 which has flowed down onto the central part of the annular jetting zone from the nozzle 12 is finely divided by the liquid jet from the annular atomizing nozzle.

An annular pressure reduction chamber 6 is provided below the liquid chamber 10 and communicates with the lower part of the conical jet from the atomizing nozzle through flange holes 5 and boss side grooves 4 formed on a flange 3.

A restraining ring 11 which is not essential but preferable is provided in contact with that exterior side wall of the pressure reduction chamber 6 which faces the axis of the atomizing nozzle, and serves to prevent adhesion of the molten metal to the side wall of the pressure reduction chamber and control the pressure of the pressure reduction chamber to the lowest value depending upon the apex angle of the conical jet or the jetting pressure. For this purpose, restraining rings having different inside diameters may be provided for replacement as desired.

Since the annular jetting zone is composed of the end members 1 and 2 which are at least partly held in press contact with each other by the outside and inside jackets 7 and 8, it forms an opening between the end members 1 and 2 by the pressure of the liquid introduced into the liquid chamber 10. Even when the opening in the annular jetting zone is as narrow as 0.1 to 0.01 mm, the opening remains uniform. This is one outstanding advantage over the prior art in which the dimension of the opening is adjusted by a screw or a packing and because of the difficulty of performing such adjustment with a high dimensional accuracy, a uniform opening cannot be provided. The provision of a uniform opening in this invention makes it easy to obtain a jet symmetrical with respect to the axis of the cone which is concentric with the axis of the annular jetting zone. Since the opening is narrow, it is easy to make the speed of the jet high. Furthermore, since the opening has a uniform dimensional accuracy, it is easy to form a non-irregular conical shape having an apex located on the axis of the annular jetting zone.

Another characteristic feature of the apparatus of this invention is the provision of the pressure reduction chamber 6 communicating with the lower part of the conical jet from the annular atomizing nozzle. By increasing the negative pressure of the pressure reduction chamber 6, namely the negative pressure of the lower part of the conical jet, a pressure difference arises between the lower portion and the upper portion of the conical jet, and the backward flowing of the jet in the upward direction can be suppressed. Accordingly, even when the liquid is jetted at a pressure of 400 to 600 kgf/cm$^2$ which is higher than jetting pressures previously used, the apex angle $\theta$ of the conical portion can be increased to nearly 90°. Consequently, very fine metal particles having an average particle diameter of 4 to 6 micrometers can be produced. In the present invention, the apex angle $\theta$ can be selected within the range of $40° < \theta < 90°$. If the apex angle is 40° or less, the resulting metal particles become coarse, and therefore, it is not suitable for the production of the fine powder intended by this invention. The jetting pressure can be selected within the range of 100 to 600 kgf/cm$^2$. If it is below 100 kgf/cm$^2$, the resulting metal particles become coarse, and it is not suitable for the production of the fine powder intended by this invention.

The pressure of the reduction chamber 6 is preferably 30 to 700 torr. If it is less than 30 torr, the jet tends to flow backward. With a jet of water or an aqueous polymer solution, it is difficult to produce a negative pressure exceeding 700 torr. Preferably, the difference between the negative pressure of the pressure reduction chamber and the negative pressure generated in the upper part of the conical jet sucking the molten metal stream is 20 to 690 torr. Since the negative pressure generated at the upper part of the conical jet does not become high, the amount of the atmospheric gas sucked by the jet is not large.

The fine powder of a metal or alloy obtained by this invention can be recovered by methods known to those skilled in the art.

The present invention can give an alloy powder having an average particle diameter of about 4 to 6 micrometers which is one-tenth of that obtained by conventional apparatus and methods. Even when the apex angle $\theta$ is near 90°, jetting can be effected stably under a pressure of as high as 400 to 600 kgf/cm$^2$, and a fine powder of a single metal or an alloy can be easily obtained efficiently.

Since the jet does not suck a large amount of atmospheric gas, its energy can be efficiently utilized.

Figure 1:
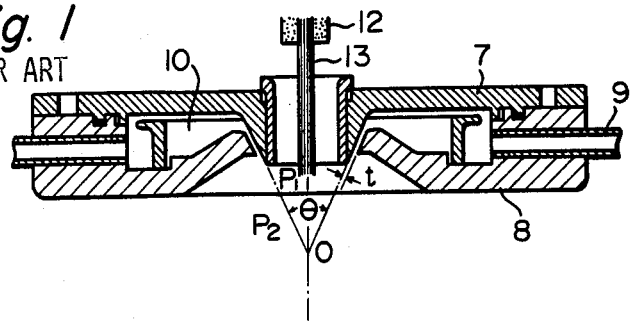
Fig. 1 PRIOR ART
FIG. 1 is a sectional view of a conventional apparatus for finely dividing a metal by atomization.

The following examples illustrate the method of producing a metal powder by the apparatus of this invention and show the superiority of the operation and advantage of the apparatus of this invention to the conventional apparatus shown in FIG. 1.

EXAMPLE 1 AND COMPARATIVE EXAMPLE 1

A 90Cu-10Sn alloy was finely divided under the conditions shown in Table 1 by an apparatus built in accordance with FIG. 1 of Japanese Patent Publication No. 6389/68 and the apparatus of the invention.

The results are shown in Table 1.

TABLE 1

| | | Conventional apparatus | | Apparatus of the invention | |
|---|---|---|---|---|---|
| Water pressure (kgf/cm$^2$) | | | 130 | | |
| Temperature of the molten metal (°C.) | | | 1230 | | |
| Diameter of the metal feed nozzle (mm) | | | 4.0 | | |
| Apex angle of the jet ($\theta$, °) | | 40 | | 60 | |
| Negative pressure (torr) | Pressure reduction chamber | 0 | | 200 | |
| | Upper part of the conical jet | 17 | | 14 | |
| | Sieve mesh | Particle diameter distribution % | Apparent density g/cm$^3$ | Particle diameter distribution % | Apparent density g/cm$^3$ |
| Properties of the powder | 80/100 | 0.4 | — | 0.1 | — |
| | 100/145 | 2.1 | — | 0.2 | — |
| | 145/200 | 9.1 | 2.65 | 2.0 | — |
| | 200/280 | 11.2 | 2.71 | 4.4 | — |
| | 280/325 | 18.2 | 2.81 | 12.0 | 2.45 |
| | −325 | 59.0 | 3.35 | 81.3 | 2.88 |

The results shown in Table 1 show that the negative pressure of the upper part of the conical jet which sucked the molten metal stream was lower, and the amount of air sucked by it was smaller, in the apparatus of this invention than in the conventional apparatus, and that the resulting powder in accordance with this invention had a much smaller average particle size and a lower density than that obtained by the conventional apparatus.

EXAMPLE 2 AND COMPARATIVE EXAMPLE 2

Iron was finely divided as in Example 1 and Comparative Example 1 under the conditions shown in Table 2. The results are also shown in Table 2.

TABLE 2

| | | Conventional apparatus | | Apparatus of the invention | |
|---|---|---|---|---|---|
| Water pressure (kgf/cm$^2$) | | | 140 | | |
| Temperature of the molten metal (°C.) | | 1680 | | 1600 | |
| Diameter of the metal feed nozzle (mm) | | | 5.0 | | |
| Apex angle of the jet ($\theta$, °) | | 40 | | 74 | |
| Negative pressure (torr) | Pressure reduction chamber | 0 | | 400 | |
| | Upper part of the conical jet | 18 | | 14 | |
| | Sieve mesh | Particle diameter distribution % | Apparent density g/cm$^3$ | Particle diameter distribution % | Apparent density g/cm$^3$ |
| Properties of the powder | 60/100 | 1.4 | — | 0.5 | — |
| | 100/145 | 3.7 | 2.00 | 0.9 | — |
| | 145/200 | 9.5 | 2.10 | 3.3 | 2.14 |
| | 200/280 | 22.2 | 2.27 | 7.0 | 2.23 |
| | 280/325 | 17.7 | 2.47 | 9.0 | 2.25 |
| | −325 | 45.5 | 3.11 | 79.3 | 2.97 |

The results show the same superiority as in Example 1. When the iron powder obtained in Example 2 was reduced in hydrogen at 930° C. for 1 hour and pulverized, the resulting powder had a density of 2.4 g/.cm$^3$. It showed moldabilty comparable to an iron powder obtained by reducing iron ore.

EXAMPLES 3–6

A 91Ni-3Mo-6W alloy, an 80Ni-20Cr alloy, high-speed steel corresponding to M2 and stainless steel corresponding to SUS410 were respectively divided into fine powders by using the apparatus of this invention under the conditions shown in Tables 3 to 6, respectively. The results are also shown in these tables.

TABLE 3

| | | |
|---|---|---|
| Water Pressure (kgf/cm$^2$) | | 400 |
| Temperature of the molten metal (°C.) | | 1650 |
| Diameter of the metal feed nozzle (mm) | | 2.0 |
| Apex angle of the jet ($\theta$, °) | | 67 |
| Negative pressure (torr) | Pressure reduction chamber | 675 |
| | Upper part of the conical jet | 18 |

| | Yield of powder (−500 mesh) % | Average particle diameter μm | Apparent density g/cm$^3$ |
|---|---|---|---|
| Properties of the powder | 95.8 | 5.6 | 2.86 |

TABLE 4

| | | |
|---|---|---|
| Water pressure (kgf/cm$^2$) | | 500 |
| Temperature of the molten metal (°C.) | | 1600 |
| Diameter of the metal feed nozzle (mm) | | 2.5 |
| Apex angle of the jet ($\theta$, °) | | 60 |
| Negative pressure (torr) | Pressure reduction chamber | 680 |
| | Upper part of the conical jet | 13 |

| | Yield of powder (−500 mesh) % | Average particle diameter μm | Apparent density g/cm$^3$ |
|---|---|---|---|
| Properties of the powder | 98.0 | 5.1 | 2.8 |

TABLE 5

| | | |
|---|---|---|
| Water pressure (kgf/cm$^2$) | | 500 |
| Temperature of the molten metal (°C.) | | 1600 |
| Diameter of the metal feed nozzle (mm) | | 2.0 |
| Apex angle of the jet ($\theta$, °) | | 48 |
| Negative pressure (torr) | Pressure reduction chamber | 670 |
| | Upper part of the conical jet | 47 |

| | Yield of powder (−500 mesh) % | Average particle diameter μm | Apparent density g/cm$^3$ |
|---|---|---|---|
| Properties of the powder | 83.0 | 4.6 | 2.30 |

TABLE 6

| | | |
|---|---|---|
| Water pressure (kgf/cm$^2$) | | 520 |
| Temperature of the molten metal (°C.) | | 1580 |
| Diameter of the metal feed nozzle (mm) | | 3.0 |
| Apex angle of the jet ($\theta$, °) | | 60 |
| Negative pressure (torr) | Pressure reduction chamber | 658 |
| | Upper part of the conical jet | 17 |

| | Yield of powder (−500 mesh) % | Average particle diameter μm | Apparent density g/cm$^3$ |
|---|---|---|---|
| Properties of the powder | 95.7 | 5.1 | 2.0 |

The results given in Tables 3 to 6 show that the resulting powders had an average particle diameter of as fine as 4 to 6 micrometers. In spite of such a fine size, the amount of the powder oxidized is about the same as that of a powder having an average particle diameter of several tens of micrometers. For example, the amount of oxygen of a 91NMi-3Mo-6W alloy powder as atomized is about 600 ppm. This shows that by high-pressure atomization, the alloy is finely divided but rapid cooling also proceeds by powderization, and therefore, the amount oxidized per particle can be drastically reduced. Particles with a size of several micrometers are nearly spherical and have relatively good compressibility.

What is claimed is:

1. An apparatus for finely dividing a molten metal by atomization, comprising a nozzle for feeding a molten metal and an annular atomizing nozzle for jetting a high-pressure liquid against a stream of the molten metal flowing from the feed nozzle, said atomizing nozzle comprising an annular jetting zone adapted to form a narrow opening therein under the pressure of the high-pressure liquid, an inside jacket and an outside jacket adjacent to said annular jetting zone, and said apparatus further including a pressure reduction chamber located beneath the atomizing nozzle and communicating with the lower part of the jet from the atomizing nozzle.

2. The apparatus of claim 1 wherein said annular jetting zone is composed of upper and lower end members which, in the absence of the pressure of the high-pressure liquid thereon, are at least partly held in press contact with each other by the inside and outside jackets of the atomizing nozzle.

3. The apparatus of claim 1 wherein a jet of the high-pressure liquid from the annular atomizing nozzle forms a conical shape concentric with the axis of the annular jetting zone.

4. The apparatus of claim 1 which further comprises an annular liquid chamber communicating with the annular jetting zone, said liquid chamber being defined by the upper and lower end members and the inside and outside jackets of the nozzle and located exteriorly of the annular jetting zone.

5. The apparatus of claim 4 which further comprises at least one liquid introducing tube communicating with the liquid chamber.

6. The apparatus of claim 1 which further comprises a restraining ring provided in contact with that exterior side wall of the pressure reduction chamber which faces the axis of the atomizing nozzle.

7. A method for finely dividing a molten metal by atomization which comprises a step of allowing a stream of a molten metal to flow down from a feed nozzle, a step of jetting a high-pressure liquid against the molten metal stream from an annular atomizing nozzle, a step of reducing the pressure of the lower part of the jet from the atomizing nozzle by means of a pressure reduction chamber communicating with said lower part, and a step of recovering the finely divided metal, the jetting of the high-pressure liquid being effected at a jetting pressure of 100 to 600 kgf/cm$^2$ so as to form a conical liquid jet having an apex angle $\theta$ of $40° < \theta < 90°$ concentrically with the axis of the atomizing nozzle, and the difference between the negative pressure of the pressure reduction chamber and that of the upper part of the conical jet being maintained at 20 to 690 torr by suction.

* * * * *